US006158156A

United States Patent [19]

Patrick

[11] Patent Number: 6,158,156

[45] Date of Patent: Dec. 12, 2000

[54] DISPLAY PANELS

[75] Inventor: David Patrick, Glasgow, United Kingdom

[73] Assignee: John McGavigan Limited, Glasgow, United Kingdom

[21] Appl. No.: 09/051,950

[22] PCT Filed: Oct. 30, 1996

[86] PCT No.: PCT/GB96/02645

§ 371 Date: Apr. 22, 1998

§ 102(e) Date: Apr. 22, 1998

[87] PCT Pub. No.: WO97/16812

PCT Pub. Date: May 9, 1997

[30] Foreign Application Priority Data

Oct. 30, 1995 [GB] United Kingdom ..... 9522135

[51] Int. Cl.[7] ..... G09F 13/08

[52] U.S. Cl. ..... 40/443; 40/541

[58] Field of Search ..... 40/443, 541

[56] References Cited

U.S. PATENT DOCUMENTS 3,499,240 3/1970 Cotton, Jr. et al. ..... 40/443

FOREIGN PATENT DOCUMENTS 4068030 3/1992 Japan .

1157563 1/1967 United Kingdom .

2 133 195 1/1983 United Kingdom .

*Primary Examiner*—Cassandra H. Davis

*Attorney, Agent, or Firm*—Myers, Bigel, Sibley & Sajovec, P.A.

[57] ABSTRACT

The invention relates to display panels suitable for use in providing information or other data for viewing in differing light conditions and/or for purely decorative purposes. Examples of panels according to the invention comprise a substrate (2) which may be rendered smokey in appearance by the use of a coating (6) of a smokey dye or by inclusion of a dye in the plastics or glass from which the substrate is formed. On the obverse side of the panel, there is provided a first layer (8) of transparent or partially transparent material in which is carried fragments of translucent material such as mica having enhanced colour iridescence by being coated with a suitable metal oxide. The layer (8) may be continuous or discontinuous. On the reverse side of the panel is provided a layer (12) including pigmented material for example in the form of graphics or other patterning to be displayed as a result of being backlit by a source of light (14) sufficiently strong to suppress the iridescence of the layer (8) visible in ambient lighting so that what was visible on the obverse face effectively disappears and the graphics of the layer (12) become visible to the observer.

24 Claims, 2 Drawing Sheets

DISPLAY PANELS

The invention is concerned with improvements in or relating to display or decorative panels having a variable visual appearance in accordance with differing light conditions.

Panels of the above description may be used for purely decorative purposes or, additionally, for the display of information on a permanent or intermittent basis. When the information is required for display only on an intermittent basis, it is considered advantageous if the presence of information graphics is not visible to an observer until the information becomes relevant to the situation and is to be displayed. A well-known technique for rendering more-or-less hidden graphics into a visible condition is to provide these on the reverse surface of a partially translucent panel and provide illumination from behind the reverse surface of the panel, i.e. from the opposite face of the panel to that viewed by the observer. Such a panel is conveniently referred to as a "back-lit" panel, or a "secret-till-lit" panel.

In such an arrangement, in addition to the information conveyed to the viewer by the hidden graphics, there may be provided further information, conveniently printed upon the obverse surface of the panel, which remains visible under all lighting conditions.

The present invention provides a display panel comprising a plurality of layers, said layers including a first, at least partially transparent, layer, and a second layer, at least selected areas of said second layer having a degree of contrast in opacity and/or colour, said first and second layers being associated with a substrate layer having an obverse surface and a reverse surface, wherein means are provided for furnishing said substrate layer with a partially transparent tinted appearance, wherein said first layer comprises a coating comprising a transparent carrier in which are supported non-opaque particulate light-splitting or light-frequency modifying materials, said materials being capable of causing light-splitting effects when viewed in light falling in the direction of the obverse surface of said substrate layer, and wherein said second layer provides said at least selected areas rearwardly of said first layer which are of predetermined size and shape, the construction and arrangement being such that the light-splitting or modifying effect caused by said particulate material in said first layer and visible in ambient light, is suppressed by the passage of light from a source located at the reverse side of the panel so that the presence of said at least selected areas become visible from the obverse side of the panel.

Advantageously, a suitable first layer may be provided by comprising an at least substantially transparent carrier containing particulate semi-transparent colour producing material. A suitable material may be a flaked, iridescent material of the kind exemplified by mica. Mica flakes may be pre-coated with ultra-thin layers of pigment, for example oxides of metals such as titanium or iron.

Advantageously, the visual effect of the presence of the pigment may be varied according to the thickness of the pre-coating. Variations may also be observed in accordance with the base colour of the substrate layer and the degree of translucency thereof.

Advantageously, said second layer may be provided as graphics in the form of information symbols applied in a discontinuous layer of an opaque or substantially opaque pigment. Conveniently said pigmented material may be printed pigmented ink or the like.

Alternatively said second layer may be colour tinted in a contrasting hue so that the colour tint is visible only on the passage of light from a source located at a reverse side of the panel.

The present invention further provides a display panel comprising a substrate layer and a coating layer applied to an obverse surface of the layer, said coating comprising non-opaque particulate light-frequency modifying materials entrained in a carrier therefor, said particulate materials being capable of causing light splitting effects when viewed in light falling upon the coated obverse surface, wherein said substrate layer is non-opaque except where provided with a layer comprising opaque or substantially opaque areas which are of predetermined size and shape, the construction and arrangement being such that the light-splitting or modifying effect caused by the particulate material and visible in ambient light is suppressed by the passage of light from a source located at the reverse side of the panel so that the presence of the opaque areas become visible from the obverse side of the panel.

In examples of panels according to the invention and their use, the panels may be comprised of a partially-transparent panel substrate which is of the kind referred to as smoke-coloured. The colour may, if preferred, be imparted to the panel in a third layer which may be applied by a printing technique but, if preferred, may be obtained by the inclusion of pigment in the plastics film or other material of the panel substrate. It may be found that high quality visual effects are obtained with the use of pigments of a relatively dark hue.

The first layer may be provided by coating the substrate with a layer including ultra-thin flakes of mica that in the present examples have been pre-coated with titanium dioxide. The coated flakes are capable of splitting light into its visible component colours, the apparent colour depending upon the thickness of the titanium dioxide layer on the mica. This varies in the present examples from 40 to 160 nm giving a range of colour from silver-white through copper-red, lilac, vivid blue, turquoise and finally green, the colour sequence being repeated if additional thickness is imparted to the titanium dioxide layer.

It should be noted that in addition to the effect described above, colour changes may be seen according to the angle from which the coated mica flakes are observed, the so-called interference colour being visible only at the glancing angle. Colours seen at the other angles will differ. For example, if a blue "interference" layer of pigmented material forms a coating on a white background, then the light reflected at the glancing angle is blue and masks the complementary colour, yellow, which is seen at other angles. On a coloured background, the transparency of the coating permits the background colour to be visible through the coating, but at the glancing angle the interference colour predominates. On a curved panel, both colour effects may be observed at the same time on differing areas of the panel to give a pleasing effect.

In a panel in accordance with the invention, the positioning of a light source behind the panel will allow light from that source to penetrate the panel and the pigmented coating of the first layer. Because the light from behind the panel is of a greater intensity than ambient light falling on the obverse surface of the panel, the colour effect visible in the first layer will be suppressed and the colours of the second layer will predominate as the panel "lights up". The provision of graphics if present in the second layer will permit symbols or the like to be visible as dark or darker areas against the back-lit panel.

The invention still further provides a panel assembly adapted to provide a variable visual appearance to a display panel constructed in accordance with the third paragraph of the present specification, said assembly further comprising a support device mounting said panel, and a source of light positioned behind the reverse surface of the panel and adapted to provide light arranged to pass through the substrate and said layers wherever the opacity thereof permits.

There will now be described a plurality of examples of panels according to the invention. It will be understood that the description which is to be read with reference to the drawings, is given by way of example only and not by way of limitation.

In the drawings

Figure 1:
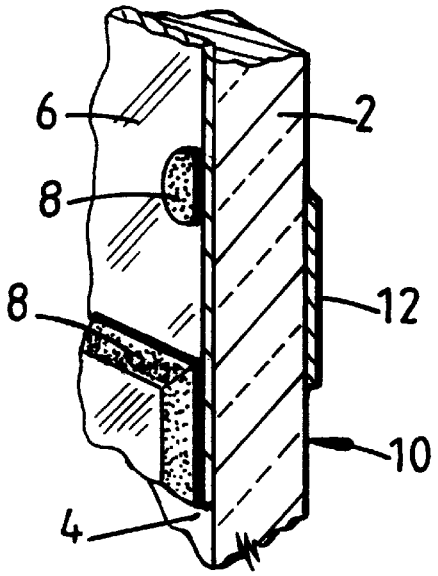
FIG. 1 is a fragmentary perspective view of a portion of a panel according to the invention.

A panel according to the invention is illustrated in FIG. 1, in which a substrate layer 2 is provided which is of plastics material, in the present example a transparent polycarbonate sheet. It will be understood that the substrate may be of any transparent material, glass or plastics and may be flexible or rigid, contoured, e.g. by a forming technique, or flat, as desired.

Applied to the obverse surface 4 of the substrate layer 2 is a layer 6 of smoky or similarly tinted material which introduces a degree of opacity to the substrate to the extent that when viewed in ambient light or daylight falling on said obverse surface 4 the panel gives a dense appearance.

The layer 6 is then provided with a layer 8 comprising a transparent coating of acrylic varnish or other suitable carrier in which is entrained a quantity of flaked mica particles which have been pre-coated with a titanium oxide pigment to give a desired colour-effect by means of the light-modifying properties of mica (iridescence). In the present example, the layer 8 is discontinuous, but if preferred it may comprise a continuous coating.

On the reverse surface 10 of the substrate 2 is provided a discontinuous applied layer 12 of an opaque or substantially opaque pigmented ink or the like in a pre-determined pattern in the present example letters or graphics. In the present example, the pattern is applied by a screen printing technique but any suitable technique may be used e.g. an off-set lithographic process.

Figure 2:
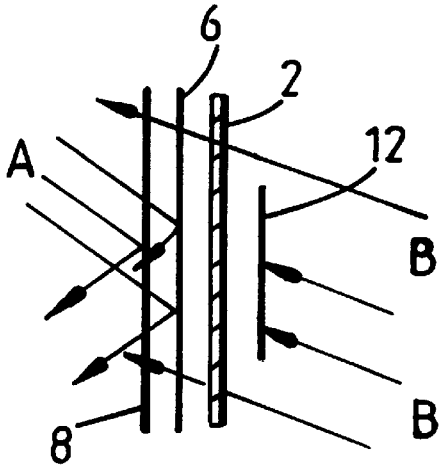
FIG. 2 is a diagram illustrating layers of the panel of FIG. 1 and the direction of light falling thereon.

The effect of light on the panel of FIG. 1 is shown diagrammatically in FIG. 2.

Ambient light or daylight is shown by arrows A falling on the obverse side of the panel (the left hand side in the Figures). The light reflects from the particles in the layer 8 and tends to be absorbed by layer 6 (smoked) so that the eye is aware only of the colour effect of the layer 8, which is at least partially iridescent.

However, a source of illumination is provided to produce light rays (arrows B) from the rear of the panel to fall on the reverse side thereof as required. These rays (B) pass through the substrate 2 and the layers 6 and 8 and are of sufficient intensity that the colour effects of these layers are suppressed and indeed it is no longer possible to see the pattern or decoration afforded by the pigmented layer 8. However, some of the rays do not penetrate the layer 12 and therefore the pattern of the pigmented ink comprising the layer 12 becomes visible to the eye through the other layers.

It will be understood that in an alternative arrangement, the layer 12 may comprise one or more contrasting colour hue(s) which predominate over the layer 8 when back illumination is present (rays B).

It will be understood that the layers may be in direct and intimate contact with each other or it may, if convenient, be preferred to provide a gap between any adjacent pair of layers.

FIGS. 3 to 6 show variations in the arrangements of the layers which are possible within the scope of the invention.

Figure 3:
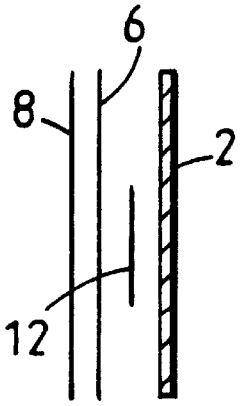
FIGS. 3 to 6 are diagrams illustrating four alternative arrangements of layers of panels according to the invention.

FIG. 3 shows an arrangement in which the layers run from left to right as follows:

(a) layer 8

(b) layer 6

(c) layer 12

(d) substrate

Figure 4:
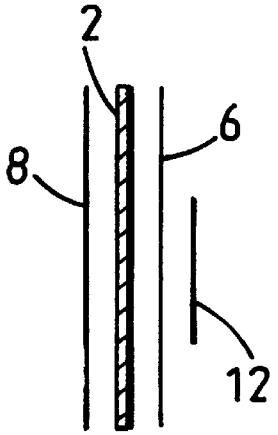

FIG. 4 has the arrangement;

(a) layer 8

(b) substrate (c) layer 6

(d) layer 12

Figure 5:
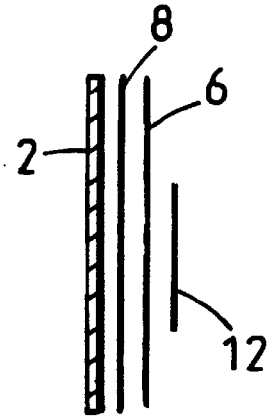

FIG. 5 has the arrangement:

(a) substrate (b) layer 8

(c) layer 6

(d) layer 12

Figure 6:
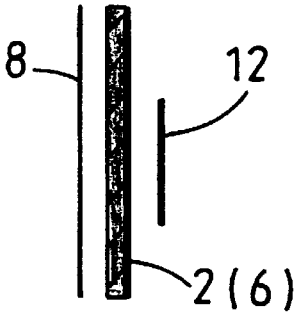

In FIG. 6 however, the layer 6 (smoked) is replaced by the provision of a smokey dye effect in the plastics material of the substrate itself. Therefore the arrangement is:

(a) layer 8

(b) substrate (with smokey effect)

(c) layer 12

Figure 7:
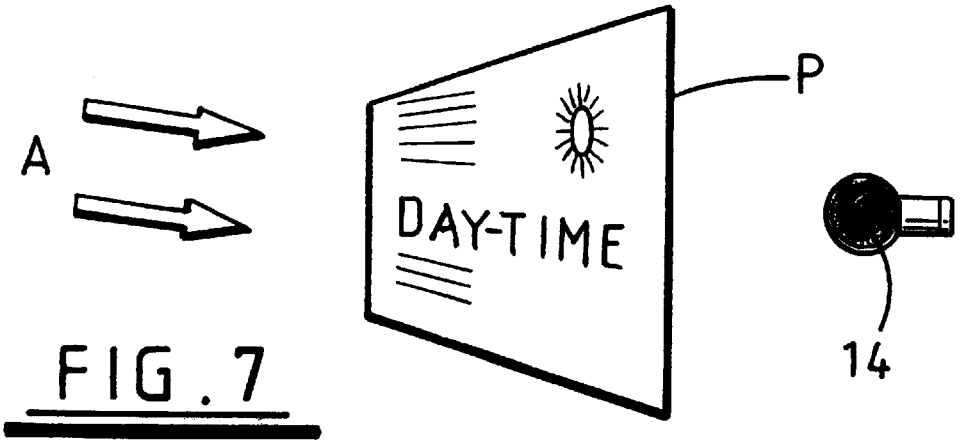
FIGS. 7 and 8 illustrate the visible effects obtained with the use of a panel according to the invention.
Figure 8:
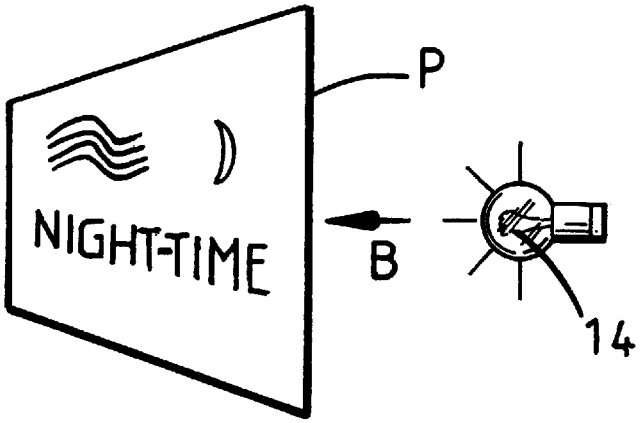

The visual effect of the use of panels according to the invention is illustrated in FIGS. 7 and 8.

A panel P having layers 6, 8 and 12 arranged on a substrate as in for example FIG. 2, is viewed in natural daylight (arrows A). The presence of the discontinuous layer 8 is viewed by the eye as a representation of the sun and the words DAY-TIME.

However, if a bulb 14 is switched on and the back light level predominates, the appearance changes to that shown in FIG. 8, in which the sun and the wording has disappeared and instead the back lighting has rendered visible the pattern of the layer 12 which depicts a crescent moon and the word NIGHT-TIME.

It will be noticed that the letters T, I, M, E, are common to the wording in both lighting conditions. This is achieved in the present example by the provision of layer 8 in two sub-layers, one which covers the general area except for gaps in the shapes corresponding to the letters and another which reads "- TIME" applied on top of the first sub-layer at the appropriate position. When the light bulb 14 is illuminated, the light shines through gaps provided in layer 12 in the shape of the letters "NIGHT-" and these are rendered visible, whereas the visibility of the letters "DAY-" has been diminished to the point where the eye cannot detect them.

In examples of panels according to the invention, it will be understood that a variety of materials may be chosen for the substrate and for the layers. Moreover, the thicknesses of the various layers may be selected as required for the purpose concerned.

For example, the thickness of the substrate layer 2 may be from, say, 0.075 mm up to 10 mm or if appropriate up to 15 or 20 mm. In providing the layer, the pigmented carrier may be an acrylic varnish or a blending base, and may for instance be water-based if preferred. The size and shape of the particles is determined by that of the mica flakes from 5 to 60 μm (microns) being suitable, although flakes up to 180 μm in size may be used and may be present in the carrier varnish in the proportions 1–10%, typically 3–5%. The thickness of the layer 8 may be between 3 and 30 μm, although a range of from 6 to 15 μm may be preferred, typically 6–7 μm.

The decorative feature of the layers 8 and 12 may be purely informative i.e. instructions or data, and may be in the form of a layer which is continuous except for shaped gaps, or comprised by "islands" of pigmented carrier.

Figure 9:
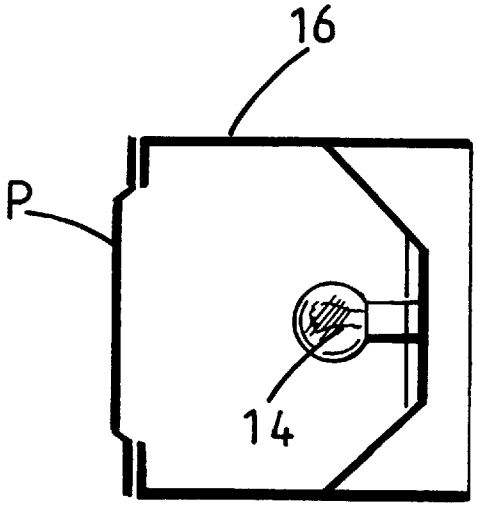
FIG. 9 is a diagrammatic cross-sectional view through a panel assembly including a panel according to the invention.

FIG. 9 of the drawings illustrates a panel P as described in any of the examples given above, which has been formed so as to be contoured, i.e. not flat as in the original sheet material, and has been mounted in a support device 16, which also supports a source of illumination for example, the bulb 14. It will be understood that the Figure is purely diagrammatic and can represent any suitable mounting and support means such as may for example be appropriate for inclusion in a vehicle dashboard or fascia display, an information panel for varying data between alternative display modes, variable-appearance decorative panels for commercial, retail or similar premises, point-of-sale displays as well as for domestic and industrial appliances, instrument panels, and the like.

Various modifications may be made within the scope of the invention as defined in the following claims.

What is claimed is:

1. A display panel comprising a front and a rear and a plurality of layers therebetween including a substrate layer (2), wherein said plurality of layers further include a first, at least partially transparent, layer (8) and a second layer (12), said first and second layers being associated with the substrate layer having an obverse surface (4) and a reverse surface (10), wherein means (6) are provided for furnishing said substrate layer with a partially transparent tinted appearance, wherein said first layer comprises a coating comprising a transparent carrier in which are supported non-opaque particulate light-splitting materials, said materials being capable of causing light-splitting effects in light falling on the obverse surface from the front and wherein said second layer provides said at least selected areas rearwardly of said first layer which are of predetermined size and shape, such that the light-splitting effect caused by said particulate material in said first layer and visible in ambient light is suppressed by the passage of light of greater intensity than the ambient light from the rear of the panel so that the presence of said at least selected areas become visible from the front of the panel.

2. A panel as claimed in claim 1, wherein said transparent carrier contains semi-transparent colour-producing material.

3. A panel as claimed in claim 2 wherein said transparent colour-producing material is coated with a metal oxide.

4. A panel as claimed in claim 5, wherein the semi-transparent material is coated with at least one of titanium dioxide and iron oxide.

5. A panel as claimed in claim 1, wherein said material is a flaked, iridescent material.

6. A panel as claimed in claim 3, wherein the material is mica.

7. A panel as claimed in claim 1, wherein said second layer is a discontinuous layer comprising substantially opaque pigment.

8. A panel as claimed in claim 7, wherein said pigment is a printed pigmented ink.

9. A panel as claimed in claim 1, wherein said second layer is colour-tinted in a contrasting hue.

10. A display panel comprising a front and a rear and a substrate layer (2) therebetween, wherein the panel further comprises a coating layer (8) applied to an obverse surface (4) of the substrate layer, said coating comprising non-opaque particulate materials entrained in a carrier therefor, said particulate materials being capable of causing light splitting effects in light falling on the obverse surface from the front, wherein said substrate layer is non-opaque except where provided with an applied layer (12) on a reverse surface (10) thereof, said applied layer comprising at least one area selected from the group consisting of an opaque area and a substantially opaque area, said at least one area being of predetermined size and shape, such that the light-splitting effects caused by the particulate material and visible in ambient light is suppressed by the passage of light of greater intensity than the ambient light from the rear of the panel so that the presence of the opaque areas become visible from the front of the panel.

11. A panel as claimed in either one of claims 1 or 10, wherein the substrate layer comprises a transparent plastics sheet, said sheet incorporating a pigment in a suitable quantity to impart a smokey tint thereto while preserving its transparency at least at a substantial level of its transparency.

12. A panel as claimed in claim 10 wherein said at least one area selected from the group consisting of an opague area and a substantially opaque area is provided by a coating of pigmented material.

13. A panel as claimed in claim 12, wherein the coating of pigmented material comprising a printed coating of ink.

14. A panel as claimed in claim 1, wherein there is provided a further, third, layer comprising a smokey tinted coating adapted to modify the appearance of the transparent carrier to impart a generally smokey appearance thereto.

15. A panel as claimed in claim 12, wherein the smokey tinted coating is provided by a printed coating.

16. A panel as claimed in any one of claims 1, 10 or 14, wherein at least one of said layers is arranged on one side of said substrate and the remaining layer(s) on the opposite side.

17. A panel as claimed in claim 12, wherein said coating layer is arranged on one side of said substrate layer and said third layer layer is arranged opposite thereof.

18. A display panel assembly adapted to provide a variable visual appearance to a display panel as claimed in any one of claims 1, 10, or 12, said assembly comprising said display panel, a support device mounting said panel, and a source of light positioned behind a reverse surface of the panel and adapted to provide light arranged to pass through the substrate layer and said plurality of layers wherever the opacity thereof permits.

19. A panel as claimed in any one of claims 1, 10, or 12, wherein said substrate layer has a thickness in the range of 0.075 mm to approximately 20 mm.

20. A panel as claimed in claim 19, wherein said substrate layer has a thickness in the range of 0.075 mm to 10 mm.

21. A panel as claimed in any one of claims 1, 10 or 12, wherein the first layer has a thickness in the range of 3 μm to 30 μm.

22. A panel as claimed in claim 21, wherein said first layer has a thickness in the range of 6 μm to 15 μm.

23. A panel as claimed in claim 21, wherein the first layer has a thickness of approximately 6 μm to 7 μm.

24. A display device including a display panel as claimed in claims 1, 10 or 12, further including a light source located at the rear of the panel.

* * * * *